US008701374B2

(12) United States Patent
Becke et al.

(10) Patent No.: US 8,701,374 B2
(45) Date of Patent: Apr. 22, 2014

(54) REFRIGERATOR DOOR

(75) Inventors: Christoph Becke, Grosskarolinenfeld (DE); Alexander Görz, Aalen (DE); Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1348 days.

(21) Appl. No.: 11/918,710

(22) PCT Filed: Mar. 29, 2006

(86) PCT No.: PCT/EP2006/061146

§ 371 (c)(1),
(2), (4) Date: Oct. 16, 2007

(87) PCT Pub. No.: WO2006/120069

PCT Pub. Date: Nov. 16, 2006

(65) Prior Publication Data

US 2009/0033190 A1 Feb. 5, 2009

(30) Foreign Application Priority Data

May 10, 2005 (DE) ..... 10 2005 021 537

(51) Int. Cl.
*E04C 2/54* (2006.01)

(52) U.S. Cl.
USPC ..... 52/784.1; 52/784.15

(58) Field of Classification Search
USPC ..... 52/784.1, 784.15; 211/90.02, 187
See application file for complete search history.

(56) References Cited

U.S. PATENT DOCUMENTS

| | | | | |
|---|---|---|---|---|
| 2,852,328 | A | | 9/1958 | Jewell et al. |
| 2,917,355 | A | | 12/1959 | Squire |
| 3,375,936 | A | | 4/1968 | Kessler |
| 3,647,075 | A | | 3/1972 | Aue |
| 4,779,939 | A | * | 10/1988 | Stich ..... 312/405 |
| 4,787,133 | A | * | 11/1988 | Lesmeister et al. ..... 29/460 |
| 4,798,425 | A | * | 1/1989 | Armstrong et al. ..... 312/321.5 |
| 4,801,182 | A | * | 1/1989 | Metcalfe et al. ..... 312/321.5 |
| 4,815,685 | A | * | 3/1989 | Roberts et al. ..... 248/221.11 |
| 5,375,924 | A | * | 12/1994 | Pohl et al. ..... 312/405.1 |
| 5,486,045 | A | * | 1/1996 | Dasher ..... 312/406 |

FOREIGN PATENT DOCUMENTS

| | | | |
|---|---|---|---|
| RU | 1813192 | A3 | 4/1993 |
| SU | 1731919 | A1 | 5/1992 |

OTHER PUBLICATIONS

"Fridge." Dictionary.com Unabridged. Random House, Inc. Jan. 31, 2011. <Dictionary.com http://dictionary.reference.com/browse/fridge>.*
International Search Report PCT/EP2006/061146.

* cited by examiner

*Primary Examiner* — Branon Painter
(74) *Attorney, Agent, or Firm* — James E. Howard; Andre Pallapies

(57) ABSTRACT

A refrigerator door includes an outer wall and an inner wall which surround an intermediate space as well as vertical bars that protrude from the inner wall and are provided with catching steps for door shelves. The bars are formed at least in part by a vertical profiled part while the catching steps are embodied on the vertical profiled part.

20 Claims, 3 Drawing Sheets

REFRIGERATOR DOOR

Figure 1:
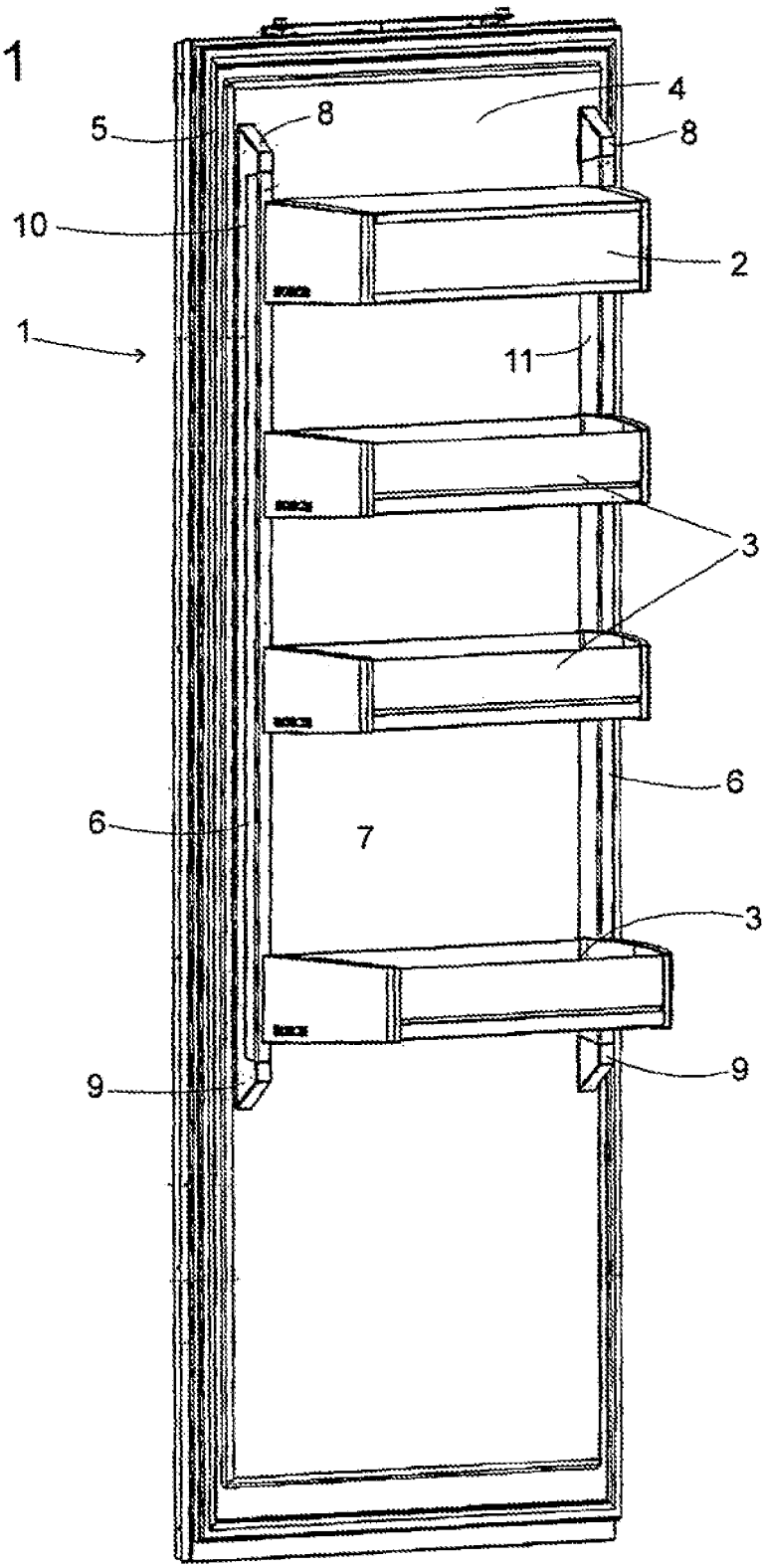

The present invention relates to a refrigerator door which is suitable for the mounting of door shelves on the inner side thereof.

In a conventional method, the door of a refrigerator is made of a firm outer wall and an inner wall that is formed by deep-drawing from a plastic blank, and an intermediate space between the outer wall and the inner wall is filled by foaming with a polymer material for thermal insulation purposes. Vertical bars are formed on the inner wall in one piece, said bars protruding from the inner wall and are provided with projections for suspending a door shelf from side surfaces facing one another.

The manufacturing process of the inner wall of the door by means of deep-drawing means that the wall thickness of the bars, in which the plastic material is more strongly stretched than that of the surrounding, essentially level regions of the inner wall of the door, is thinner than that of these neighboring regions, and the projections formed from the flanks of the bars are in turn more thin-walled than the remainder of the bar. Therefore, a substantial material thickness of the inner wall is necessary in order to ensure a sufficient load bearing ability of the projections supporting the door shelves. In particular, in the case of door shelves protruding well beyond the bars, not only the weight of the door shelves and the foodstuffs stored thereon acts on the projections, but over and above that substantial forces can occur by a lever action, which exerts a substantial load on the projections.

There is therefore a need for a refrigerator door which makes possible a safe and loadable suspension of the door shelves, which are heavy and/or protrude far from the inner wall of the door.

The object is achieved by means of the fact that for a refrigerator door comprising an inner wall and an outer wall which surround an intermediate space, as well as vertical bars that protrude from the inner wall and are provided with catching steps for door shelves, the bars are formed at least in part by a vertical profiled part, while the catching steps are embodied on the profiled part.

Because the profiled part, in particular if it extends over a plurality of catching steps, can have a substantial vertical expansion, horizontal force components, which are to be introduced from the profiled part into the inner wall of the door, are small when compared to the case of the conventional direct suspension of the door shelves on the projections formed from the inner wall of the door, and the problem of the horizontal forces which are based on the lever action in essence only arises on the catching steps of the profiled part itself. Since the profiled part is however a component separated from the inner wall of the door, it can be designed problem-free with the necessary wall thickness and rigidity, without it being necessary that the entire inner wall would have to be made thicker at the same time than is necessary for the level regions thereof.

The profiled part is preferably an extruded profile of a metal, in particular aluminum or stainless steel.

For aesthetic reasons and in the interests of easy cleaning, the profiled part should be closed at its ends. This can be carried out easily and in an attractive manner with a projection formed from the inner wall.

The profiled part is preferably fastened to the inner wall by means of screws.

In the case of a profiled part with a rear wall resting against the inner wall of the door and an outer wall, in which the catching steps are formed in the form of openings, the screws can be used in such a way in an advantageous manner that they penetrate the rear wall and are accessible through the openings of the outer wall, in order to release or tighten them. In this way, the profiled part can be mounted or dismantled at ease, but the screws used for the fastening thereof are hidden as soon as the openings of the catching steps are covered by the door shelves suspended from them.

In order to simplify the mounting of the screws, the rear wall of the profiled part is preferably aligned obliquely in relation to a main surface of the door, so that the screw introduced through the opening of a catching step meets the rear wall approximately in a vertical direction.

In order to ensure a firm seat of the screws, said screws with a backing piece accommodated in the intermediate space of the door are preferably positioned in threaded engagement. This backing piece, which can likewise in an appropriate manner consist of metal, further reduces the requirements made on the strength of the inner wall of the door.

With the aid of limbs that protrude into the intermediate space and are embedded in an insulating material layer filling the intermediate space, the backing piece is not only supported on the inner wall of the door, but also anchored in the insulating material layer.

Figure 2:
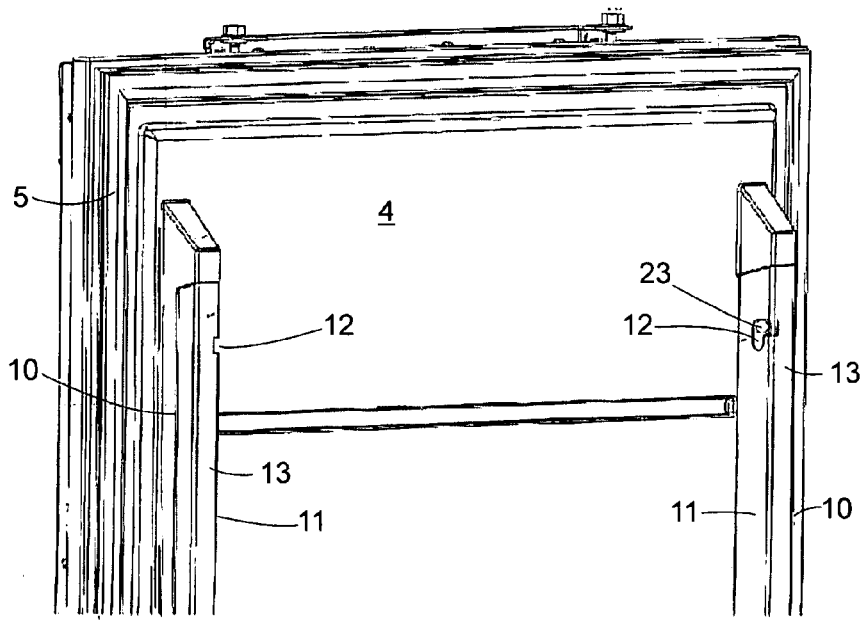
Figure 3:
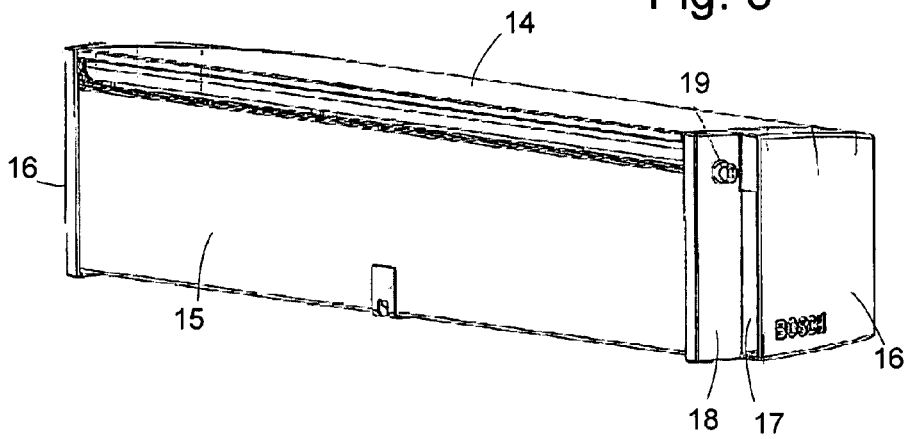
Figure 4:
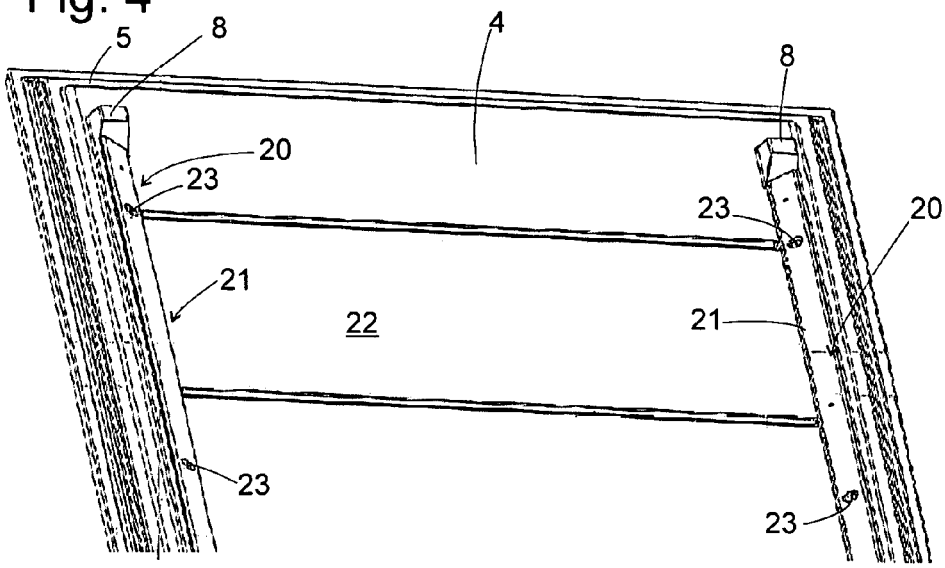
Figure 5:
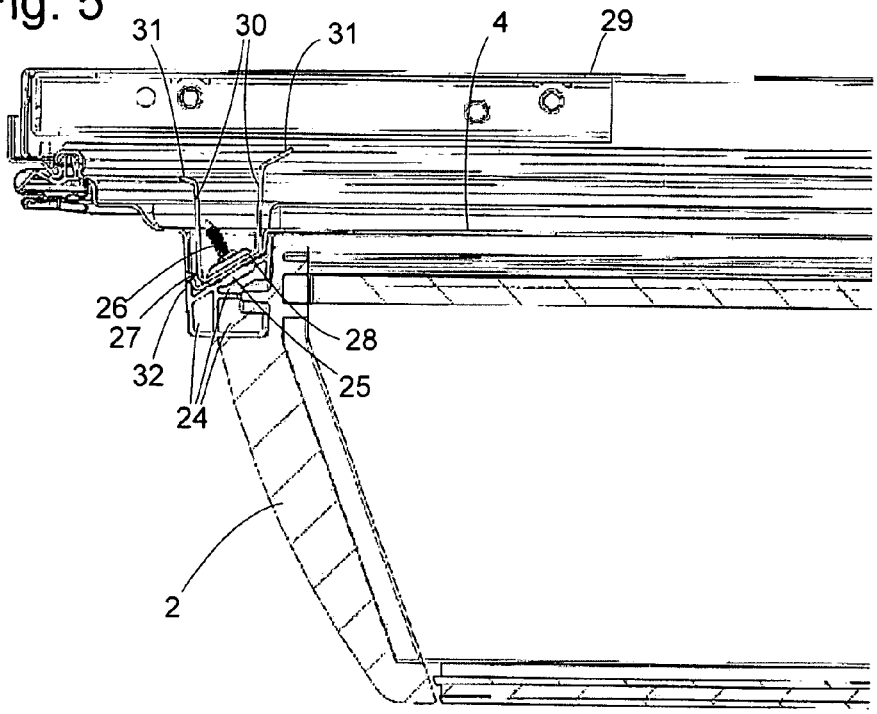

Further features and advantages of the invention will emerge from the description which follows of exemplary embodiments with reference to the accompanying drawings. These show:

FIG. 1 a perspective view of a refrigerator door in accordance with the invention with door shelves mounted thereon;

FIG. 2 a partial perspective view of the door with omitted door shelves;

FIG. 3 a door shelf seen from the rear side thereof facing the door;

FIG. 4 a partial perspective view of the door with omitted extruded profiles; and FIG. 5 a horizontal section through the door shown in FIG. 1.

FIG. 1 is a perspective view of a refrigerator door 1 fitted with door shelves 2, 3. In a manner which is known per se, the refrigerator door 1 is made of an outer wall which faces away from an observer in the figure and an inner wall 4 of plastic, which are joined in a foam-tight manner to each other hidden behind a peripheral magnetic seal 5 in order to form the boundary of an intermediate space filled with an expanded polymer material as the insulating material.

Two vertical bars 6 protrude from the inner wall 4 adjacent to the side edges thereof, from which the door shelves 2, 3 are suspended. The bars 6 have in each case an upper end section and a lower end section 8, 9, in which they in a conventional method are deep-drawn in one piece to their entire depth from the sheet of the inner wall 4. Between the end sections 8, 9, the bars 6 are deep-drawn only to a part of their depth from the inner wall 4, and the resulting recesses of the bars 6 between the end sections 8, 9 are in each case filled by an extruded profile 7 of aluminum on all sides in a flush manner. Catching steps that are not shown in the figure and to which the door shelves 2, 3 are fastened are embodied in the extruded profile 7.

FIG. 2 is a perspective view of the upper region of the refrigerator door 1 without the door shelves. As can be seen here, the extruded profile 7 on the outer sides 10 of the bars 6 facing away from one another extends approximately over half of the depth thereof, whereas the side surfaces 11 facing one another between the end sections 8, 9 are completely filled by the extruded profile 7. A catching step 12 for a door shelf is formed by an opening milled into the extruded profile 7, which extends over a part of a top face 13 of the extruded profile 7 and in an angular manner to the side surface 11.

FIG. 3 shows the door shelf 2 intended to be mounted on the catching steps 12, seen from the rear side thereof facing the door 1 in the mounted state. The represented door shelf 2 is configured as a butter compartment, with a pivotable flap 14 which forms an upper side and a front side of the door shelf 2 facing the inside of a refrigerator, onto which the door 1 is mounted, a rear side 15, a base and end faces 16. The end faces 16 are subdivided by means of a step 17 into a clearly visible region and a region 18 set back in the mounted state in relation to and resting on the side surface 1 of an extruded profile 7. A lug 19 protrudes from the region 18 and is provided in order to be hooked into the catching step 12 of the extruded profile 7.

FIG. 4 is a second perspective view of the upper region of the refrigerator door 1, this time with omitted extruded profiles 7. As can be seen here, said extruded profiles between the end sections 8, 9 cover a rib 20 formed in one piece from the inner wall 4 of essentially triangular cross-section, whereby flanks of the two ribs facing away from one another in each case form a part of the outer sides 10, and flanks of rib 20 facing one another, which in each case form an obtuse angle with an intermediate central flat surface 22 of the inner wall 4, are hidden by the extruded profiles 7 in the fully mounted state. A plurality of screw holes 23 are to be seen on the flanks of rib 21.

FIG. 5 shows a horizontal section through the door 1 and a door shelf 2 suspended thereon at the height of the latter's lug 19. As can be seen here, the extruded profile 7 is a hollow profile with a plurality of internal chambers 24 and a rear wall 25 resting on the flank 21. The rear wall 25 and the flank 21 are in each case penetrated by a screw 26 at the height of each catching step 12, the head of said screw, which cannot be seen in the figure and which rests on the rear wall 25, pressing said rear wall 25 against the flank 21. The screw 26 is anchored in a backing piece 27 of sheet metal, in this case having for instance a U-shaped profile with a central section 28 resting on the inner side of the flank and comprising two limbs 30 from the central section 28 engaging in the intermediate space between the inner wall 4 and the outer wall 29 of the door which is filled with an insulating material not shown in the figure. The backing piece 23 extends in a vertical direction over the entire length of the extruded profile 7. The limbs 30 consist of diverging end sections 31, which make it possible to introduce a horizontal tensile force exerted by the screw 26 onto the insulating material over a large area. Thus, the insulating material is also used in this way for holding the door shelf 2, 3 so that the thickness of the inner wall 4 can be made particularly small.

A part of the outer side surface 10 of every bar 6 is formed by a short web 32, which extends from the extruded profile 7 beyond the rear wall 25 resting on the flank 21 towards the front side of the door and engages in a narrow recess between the outer flank and the flank 21 of the rib 20. Thus a smooth, flush transition between the extruded profile 20 on the outer side surface 10 of the bar 6 is retained on the one hand and, on the other hand, the position of the extruded profile relative to the direction of the width of the door 1, adopted by the extruded profile 7 after tightening the screws 26, is clearly determined, so that a well-defined distance between the side flanks 11 of the two bars 6 facing one another is kept in this way.

The invention claimed is:

1. A refrigerator door comprising:

an outer wall;

an inner wall, the inner and outer walls delimiting an intermediate space, the inner wall having:

a first upper protrusion, a second upper protrusion, a first lower protrusion, and a second lower protrusion, the upper and lower protrusions being integrally molded parts of the inner wall;

a first vertical bar insert positioned between the first upper protrusion and the first lower protrusion; and a second vertical bar insert positioned between the second upper protrusion and the second lower protrusion, wherein the first and second vertical bar inserts have catching steps for securing door shelves to the first and second vertical bar inserts, each of the first and second vertical bar inserts extending over a plurality of the catching steps, the first vertical bar insert being closed at its ends by the first upper protrusion and the first lower protrusion, the second vertical bar insert being closed at its ends by the second upper protrusion and the second lower protrusion, the first and second vertical bar inserts each have an inner side surface, the inner side surface of the first vertical bar insert facing the inner side surface of the second vertical bar insert, and wherein the catching steps are recesses in the inner side surfaces of the first and second vertical bar inserts.

2. The door as claimed in claim 1, wherein the first vertical bar insert has a rear wall that rests against a first contact portion of the inner wall of the door, and second vertical bar insert has a rear wall that rests against a second contact portion of the inner wall of the door.

3. The door as claimed in claim 2, wherein the rear walls of the first and second vertical bar inserts are aligned obliquely in relation to the outer wall of the door.

4. The door as claimed in claim 3, wherein the first and second upper protrusions and the first and second lower protrusions protrude from a main surface of the inner wall farther than the rear walls protrude from the main surface.

5. The door as claimed in claim 3, wherein the catching steps are L-shaped.

6. The door as claimed in claim 1, wherein the catching steps are L-shaped.

7. A refrigerator door comprising:

an outer wall;

an inner wall, the inner and outer walls delimiting an intermediate space, the inner wall having:

a first upper protrusion, a second upper protrusion, a first lower protrusion, and a second lower protrusion, the upper and lower protrusions being integrally molded parts of the inner wall;

a first vertical bar insert positioned between the first upper protrusion and the first lower protrusion; and a second vertical bar insert positioned between the second upper protrusion and the second lower protrusion, wherein the first and second vertical bar inserts have catching steps for securing door shelves to the first and second vertical bar inserts, each of the first and second vertical bar inserts extending over a plurality of the catching steps, each of the vertical bar inserts is an extruded profile formed of metal, the first vertical bar insert being closed at its ends by the first upper protrusion and the first lower protrusion, the second vertical bar insert being closed at its ends by the second upper protrusion and the second lower protrusion, the first and second vertical bar inserts each have an inner side surface, the inner side surface of the first vertical bar insert facing the inner side surface of the second vertical bar insert, and wherein the catching steps are recesses in the inner side surfaces of the first and second vertical bar inserts.

8. The refrigerator door as claimed in claim 7, wherein the first and second vertical bar inserts are fastened to the inner wall by means of screws.

9. The refrigerator door as claimed in claim 8, wherein the first and second vertical bar inserts each have a rear wall resting against the inner wall of the door, the first and second vertical bar inserts each have front wall, and the screws that fasten the first and second vertical bar inserts to the inner wall of the door penetrate the rear wall and are accessible through openings in the front wall.

10. The refrigerator door as claimed in claim 9, wherein the rear walls of the first and second vertical bar inserts are aligned obliquely in relation to the outer wall of the door.

11. The refrigerator door as claimed in claim 7, wherein each of the first and second vertical bar inserts is fastened to the inner wall by means of screws, each of which is positioned in threaded engagement with a respective backing piece accommodated in the intermediate space of the door.

12. The door as claimed in claim 11, wherein each backing piece has limbs that protrude from the inner wall into the intermediate space delimited by the outer wall and the inner wall, and the limbs are embedded in an insulating material layer filling the intermediate space.

13. The door as claimed in claim 7, wherein the first vertical bar insert has a rear wall that rests against a first contact portion of the inner wall of the door, and second vertical bar insert has a rear wall that rests against a second contact portion of the inner wall of the door.

14. The door as claimed in claim 13, wherein the rear walls of the first and second vertical bar inserts are aligned obliquely in relation to the outer wall of the door.

15. The door as claimed in claim 14, wherein the catching steps are L-shaped.

16. The door as claimed in claim 13, wherein the first and second contact portions of the inner wall of the door protrude relative to other adjacent portions of the inner wall of the door.

17. The door as claimed in claim 16, wherein the rear walls of the first and second vertical bar inserts are aligned obliquely in relation to the outer wall of the door.

18. The door as claimed in claim 16, wherein the first and second upper protrusions and the first and second lower protrusions protrude from a main surface of the inner wall farther than the rear walls protrude from the main surface.

19. The door as claimed in claim 7, wherein the catching steps are L-shaped.

20. The door as claimed in claim 19, further comprising a shelf removably attached to the first and second vertical bar inserts, the shelf having:

an end face on each of two opposite sides of the shelf, a recessed end region that is stepped in from each end face, a step between each end face and its associated end region, and a lug protruding from each recessed end region, wherein each lug engages one of the catching steps, and each step rests on one of the first and second vertical bar inserts.

* * * * *

UNITED STATES PATENT AND TRADEMARK OFFICE

CERTIFICATE OF CORRECTION

PATENT NO. : 8,701,374 B2
APPLICATION NO. : 11/918710
DATED : April 22, 2014
INVENTOR(S) : Becke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1487 days.

Signed and Sealed this
Twenty-ninth Day of September, 2015

Michelle K. Lee

Michelle K. Lee
*Director of the United States Patent and Trademark Office*